US007810859B1

(12) United States Patent
Montusi

(10) Patent No.: US 7,810,859 B1
(45) Date of Patent: Oct. 12, 2010

(54) PET WASTE PICKUP AND DISPOSAL SYSTEM

(76) Inventor: Robert Montusi, 171 Lakebridge Dr. North, Kings Park, NY (US) 11754

( * ) Notice: Subject to any disclaimer, the term of this patent is extended or adjusted under 35 U.S.C. 154(b) by 108 days.

(21) Appl. No.: 12/317,311

(22) Filed: Dec. 22, 2008

Related U.S. Application Data

(60) Provisional application No. 61/008,756, filed on Dec. 26, 2007.

(51) Int. Cl.
*A01K 29/00* (2006.01)
*E01H 1/12* (2006.01)

(52) U.S. Cl. ..... 294/1.3; 294/1.4; 294/118

(58) Field of Classification Search ..... 294/1.3, 294/1.4, 1.5, 55, 118; 15/257.1, 257.6, 257.2, 15/104.8; 119/161
See application file for complete search history.

(56) References Cited

U.S. PATENT DOCUMENTS 906,626 A * 12/1908 Hensley ..... 56/333
3,560,039 A * 2/1971 Gruber ..... 294/1.3
3,778,097 A * 12/1973 Dorzan ..... 294/1.4
3,827,098 A * 8/1974 Sanderson ..... 294/1.4
3,879,079 A * 4/1975 Nicholas ..... 294/1.4
D240,838 S * 8/1976 Nitu ..... D30/162
4,231,602 A * 11/1980 Kinney ..... 294/1.4
D292,035 S * 9/1987 Aksamit ..... D30/162
5,039,149 A * 8/1991 Gish ..... 294/1.4
5,186,506 A * 2/1993 Gale ..... 294/1.3
6,095,579 A * 8/2000 Nichols ..... 294/1.3
6,227,149 B1 * 5/2001 Host et al. ..... 119/867

* cited by examiner

*Primary Examiner*—Dean J Kramer
(74) *Attorney, Agent, or Firm*—Leo G. Lenna

(57) ABSTRACT

An animal waste pickup and disposal device specifically designed to be inexpensive, simple to use and prevent a user from coming into direct contact with the animal waste either while picking it up, disposing of the waste, or after or during cleanup. The device having a bag on one part of the device to collect the waste and a shovel that is covered with a pad or sleeve that pushed the waste into the bag. The pad or sleeve designed to cover the shovel so as to protect it from becoming soiled in the process.

15 Claims, 5 Drawing Sheets

PET WASTE PICKUP AND DISPOSAL SYSTEM

CROSS-REFERENCE TO RELATED APPLICATION

This application is a non-provisional application and claims benefit to provisional application having the Ser. No. 61/008,756 filed Dec. 26, 2007, the disclosure of which is incorporated herein by reference in is entirety.

FIELD OF THE INVENTION

This invention relates generally to pet waste removal systems and in particular to a pet waste removal system useful for picking up and disposing of pet feces.

BACKGROUND OF THE INVENTION

The present invention relates to animal waste collection devices and methods. In particular, the invention relates to animal waste collection devices and methods that are used in combination with a bag for collecting, storing, and disposing of the animal waste.

Reports indicate that the American population is outnumbered by their pets. In fact, it has been reported that Americans are outnumbered by their pet dogs alone, which number more than 250 million by some estimates. As these numbers increase, the public demand for animal regulation increases correspondingly, responsive to the public health and safety concerns related to the high population of pet animals.

Generally, pet owners residing in municipal regions are subject to ordinances requiring that their animals be leashed at all times in public, and restrained in private to prevent uncontrolled wandering. In addition to these ordinances, most municipalities have promulgated so-called "pooper-scooper" ordinances, which require pet owners to accept personal responsibility for collection and disposition of the waste material produced by their pet animals. A typical ordinance instituted recently provides that to avoid criminal charges, you must immediately place the waste in a plastic bag, securely tied, and then place it in a solid waste container. The enforcement of some ordinance specifies fines, jail time, and probation as penalty for violation. Clearly, the social trend that started years ago in the cities has now spread to the entire country, including some rural areas.

When pet owners are subject to both leash-laws and pooper-scooper ordinances, the owner is obliged to (a) "walk" their pet on a leash and (b) retrieve and dispose of pet wastes when and where the animal decides to relieve itself. This distasteful routine is familiar to all responsible dog owners and many bystanders. Because of the distastefulness of this routine, many less responsible dog owners leave the waste where it lies. A local legislative body may respond to this problem by instituting severe sanctions for such behavior, such as the type of penalties exemplified above. Practitioners in the art respond to the problem by proposing means designed to minimize the unpleasantness of the gathering and disposal of such animal waste.

For instance, many devices have been designed in order to make the "pooper-scooper" ordinance easier and more pleasurable to obey. Early devices on the market designed to tackle this challenge were designed with relatively long-handles attached to a mechanical apparatus to "scoop" up the "poop," thereby coining the name pooper-scooper. The early designs weren't concerned with retrieving dog wastes without soiling the owners' hands. Unfortunately, the first such pooper-scoopers were large and awkwardly configured devices that were inconvenient to carry and often soiled in use. In using this or later versions and designs of pooper-scoopers, a rigid tray or scoop is employed to scoop up the waste material as best as possible. Picking up pet waste with these devices often resulted in a soiled device both in the vicinity of the waste and the tray itself. Further, this design as well as others often requires the use of both hands, which is extremely difficult when holding a pet's leash and/or an umbrella.

Even if a disposable bag is placed within the tray, no means are provided for cleanly gathering all of the waste material into the bag. This omission usually obliges the user to employ a twig, branch, or other readily available item as a tool, hose or scraper for manipulating the waste material from the device into the bag.

Accordingly, to date pet-owners (and others) are confronted with pet waste that can be collected using only an awkward scoop or shovel or, worse, a simple plastic bag for use together with whatever other "tools" may be afforded by their immediate environment. This task is very unpleasant, in fact it is so unpleasant that, as stated above, local ordinances are often ignored and pet waste is commonly left where it lies, creating social, public-health, and legal problems for the pet owner and others. Other solutions known in the art such as, but not limited to, disposable surgical gloves, paper tissues, sandwich bags and the like do little to reduce the well-known unpleasantness of the pet sanitation task. None of these alternatives provides for simple sanitary gathering and bagging of pet waste and equipment clean up.

Bad enough the task of picking up pet waste must be done to comply with local laws; it is often equally embarrassing to carry a huge awkward device that everyone knows is used and has been used in the past to shovel pet feces into a bag. This becomes even more embarrassing when neighbors stop and talk to the pet owner as he or she stands in front of them with a huge poopy scooper that may even smell if it has been recently used and is soiled.

Accordingly, a need exists for an animal waste removal system that is easy to use, prevents the user from getting soiled, and does not require simultaneous use of both hands, since using two hands presents a problem with respect to retention of the pet leash and/or umbrella. That is, if the waste pick-up device requires two hands for use, the leash must be put down which is undesirable since the pet may run away. An alternative to putting the leash down and risking that the dog may possibly run away is to slip the leash onto a wrist, which is undesirable as retention of the leash is difficult and operation of the waste pick-up device is considerably hindered.

All in all a need currently exist for an animal waste removal system that is sanitary (in that it is not soiled in the pick-up operation), is easy to use, is easily stored, can be used with one hand, can be used for multiple pick-ups and is relatively inexpensive. The present invention is directed to an improved system which is capable of easily and sanitarily cleaning up animal waste and solves the problems raised or not solved by existing material removal systems. Of course, the present invention has a multitude of uses involving the removal and disposal of materials other than animal feces and should not be so limited.

The present invention is further described below in the figures and description thereof.

SUMMARY OF THE INVENTION

The present invention provides a animal waste pickup and disposal system specifically designed to be simple to use and prevent the user ever coming into direct contact with the animal waste being disposed either while picking it up, disposing of the waste, or after during cleanup. In fact the present invention is virtually clean up free.

In one embodiment of the invention, an animal waste collection device for collecting waste into a bag without soiling a user of the animal waste collection device is provided. The animal waste collection device comprises a first elongated handle and a second elongated handle. The first and second elongated handles are connected to each other at a pivot point that is positioned so as to movably connect the first and second handles to provide a scissor-like movement. Depending on the length of the two handles, the position of the pivot point will vary. That is, it is within the present invention to use first and second elongated handles of different sizes ranging from about six inches (for cleaning the cages of small animals such as Gerbils or Ginny pigs) to about 4 feet (for picking up animal waste from the floor without bending). Preferably, the device is about 1 foot in size, which allows for easy storage, easy carrying and for easy concealment when walking the dog.

In one embodiment of the present invention the first elongated handle terminates at one end with a shovel/paddle means that is designed for pushing waste in a defined direction and a handle grip at the opposite end. The second elongated handle terminates at one end with a rim means for attaching/holding a bag in an open position and a handle grip at the opposite end. The rim means is configured to receive a bag having an open end for receiving and storing animal waste pushed therein by the shovel means. The rim means is specifically configured to removably attach the bag to the rim means to provide access to an interior of the disposal bag used for collecting waste. The movement of the handle grips of the first and second elongated handles towards one another causes the shovel means to move in the direction of the open bag attached to the rim means so as to collect the animal waste in the bag for disposal.

In another embodiment of the present invention the animal waste collection device for collecting waste in a bag can further comprise a disposable soil pad and/or protective sleeve that is removably attached to the shovel means. The disposable soil pad and/or protective sleeve is configured to prevent the shovel means from getting soiled with the animal waste when it is used to push the waste into the open bag of the waste collection device. Once the pad/sleeve is used, it can be removed and placed into the disposal bag for disposal with the animal waste. The animal waste collection device for collecting waste in a bag of the present invention may further comprise an attaching means for holding the disposal bag on the rim means.

In another embodiment of the present invention, the first and second elongated handles are sized so as to allow a user to pick-up and remove waste from the ground without having to bend. This configuration of the present device comprises handles that are about 2 to about 4 feet in length and would allow users with limited range of motion to use the device. In other words, elderly users as well as users with bad backs can use the device of this embodiment.

In yet another embodiment of the present invention, the animal waste collection device for collecting waste in a bag may further comprise a quick release lever attached to the attaching means for holding said bag on said rim means configured to release the disposal bag from the rim means upon activation. This configuration further ensures that the user can dispose of the animal waste without coming in direct contact with the waste.

Also provided is a method for removing and disposing of animal waste using the device of the present invention, as well as a kit including the device of the present invention and bags and shovel pads/sleeves for use with the device. Additional description and detail of the present invention is provided in the figures and the detailed description below.

DETAILED DESCRIPTION OF THE INVENTION

Figure 1:
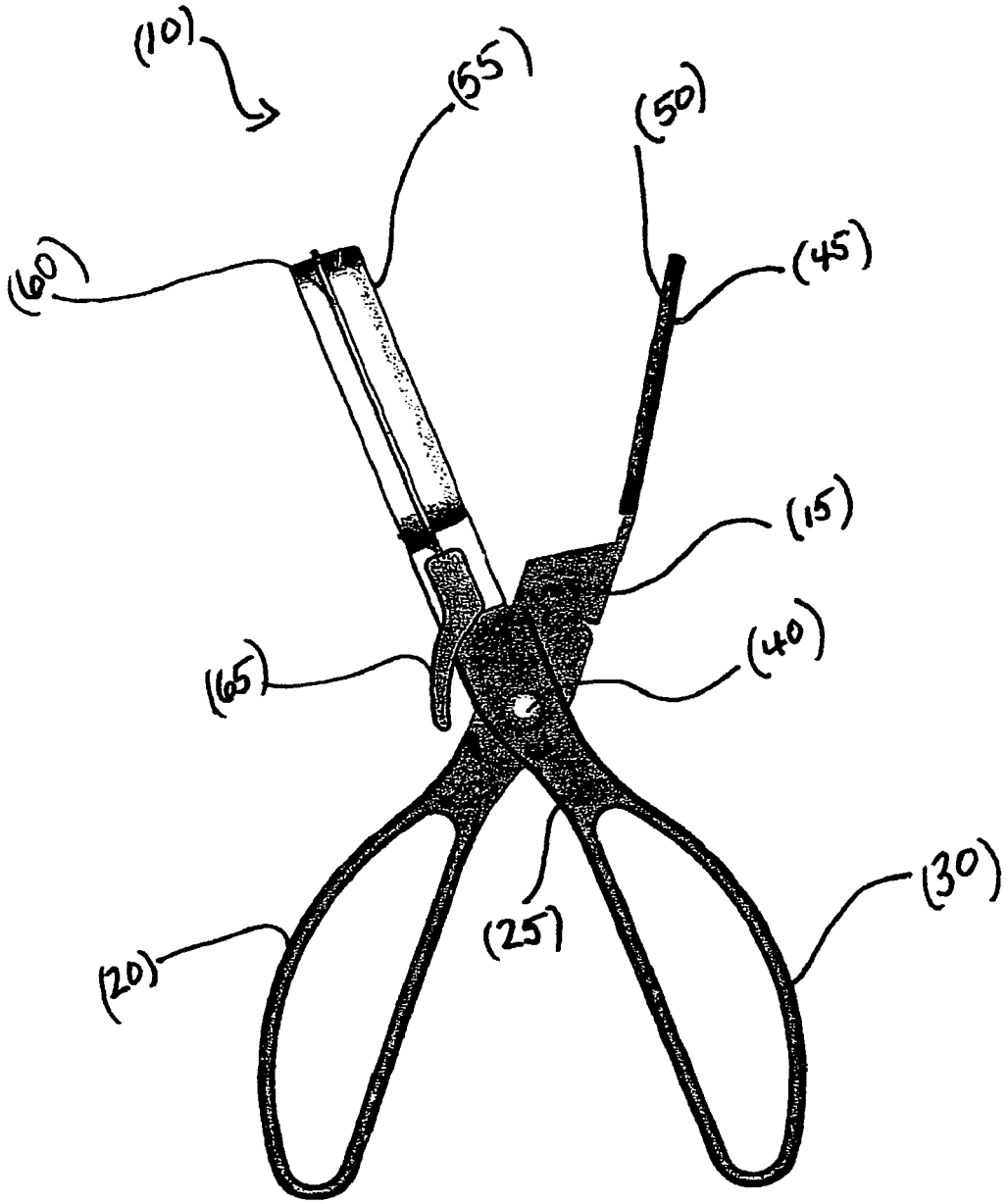
FIG. 1 shows an overhead view of the device in the open position.

The present invention is directed to a conveniently sized device for scooping up pet waste without getting the user soiled with the waste in the process. In particular, the present invention is directed to an animal waste collection device for collecting waste into a bag for disposal. The animal waste collection device comprises first and second elongated handles. The first and second elongated handles are connected to each other at a pivot point positioned approximately at the midpoint of the handles so as to provide a scissor-like movement when the handles are moved towards and away from each other. The movement produced by the present invention is similar to the movement associated with salad tongs attached together at a pivot point and can be achieved using one hand.

In one embodiment of the present invention, the first elongated handle terminates at one end with a shovel means for pushing waste in a defined direction. The shovel means can be configured to have a substantially flat paddle shaped surface that is used to push pet feces, (either dogs, cats in a liter box, or hamster or guinea pigs in a cage) towards the open disposal bag. The shape of the shovel means can also be semi-curved concavely or convexly, or can be ridged or framed. The second elongated handle terminates at one end with a rim means that is used for attaching a bag and holding the bag in an open position so that animal waste can be pushed into the open bag by the shovel means. The rim means is adapted to hold a bag for receiving animal waste pushed therein by the shovel means of the device. The open end of the bag can be secured to the rim means by an attachment means so as to provide access to an interior of the bag for collecting waste without the user touching the bag. The attachment means is also designed to release the bag after it is filled with waste again without touching the bag and getting soiled by the waste.

In one embodiment of the present invention, the rim means of the device is configured to have a unique release trigger that when activated releases the disposal bag without ever coming in contact with the user's hand. The shovel portion of the device is configured to accept either papers and/or plastic sleeves that prevent the shovel from becoming soiled as it is used to push the feces into the disposal bag. Once this is used, the paper and/or plastic sleeves can be removed and placed into the disposal bag. The paper pad and/or plastic sleeves used with this device can be specially shaped with tabs that allow the user to remove them and dispose of them without ever being soiled.

More particularly, the shovel means can be covered with either a flat piece of paper having an adhesive backing for non-permanent attachment to the surface of the shovel means prior to pushing the waste into the open bag set on the rim means. In the alternative, the shovel means can be covered with a protective sleeve in the shape of a bag having one open end that is able to slide over the shovel means and protect it from being soiled. The protective sleeve should be sized so as to tightly fit over the shovel means so as to stay in place but not so tight that it is difficult to get off during cleaning. The protective sleeve protects the complete shovel means from getting soiled when the device is used and is featured as part of a preferred embodiment of the invention. In another embodiment the shovel means can also have slits configured to insert a paper pad that is used to avoid contact of the waste with the surface so as to avoid a messy clean up.

If the flat paper is used to protect the shovel means from becoming soiled, the flat piece of paper can be configured similar to a Post it tab, having a low cost and being easy to use. The paper can simply be removed from a stack of similar papers bonded at the top by binder and once removed adhered to the surface of the shovel means. Once the paper or protective sleeve is in place, the waste can be pushed into the open bag and before discarding the bag; the paper or protective sleeve can be removed from the shovel means and placed into the bag with the waste. The shovel means can be configured so as to have a release system that allows for the protective sleeve or paper to be removed without touching the sleeve or paper so as to prevent any direct contact with the user's hand.

Once the protective sleeve or paper is removed, the bag can then be disposed of along with the soiled protective sleeve or paper, leaving the equipment relatively clean. Should the device have to be used multiple times, the collecting bag and/or shovel protective sleeve or paper could remain on the device until all waste is picked up, or if multiple bags are necessary to pick up the waste, additional protective devices can be used as needed.

The device can be made of any material that is strong enough to support the weight of the waste to be hauled away and the forces involved in the pushing action associated with the shovel means of the device. That is, the device can be made from metal, reinforced plastic, composite material, poly vinyl chloride (PVC) fiberglass, alloy or manmade materials. The device can be made in different sizes and in different colors. All of which fall within the envisioned scope of the invention. The device of the present invention can be made in separate parts assembled to make the device or can be a fully or partially molded structure. In particular, the device of the present invention can be fully or partially made by injection molding, casting, forging, sheet stock, or can simply be assembled from parts that may be taken from stock.

The pivot used to hold the two handles together at the "scissor point" can either be molded directly into each of the handles so that when put together provide the pivoting action necessary to use the device or in the alternative, the pivot point can be an external piece fastened to the handles so as to provide the pivot action necessary. In the simplest form, the pivot can be a rivet or grommet that attaches one handle to the other. More advanced pivot devices can include locking mechanisms for locking the device in closed position when not in use. It is understood by the inventor of the current invention that the pivot point is not novel and there are existing ways in the field to provide a pivot point, all of which can be used in the present invention.

The device of the present invention is further shown in FIGS. 1-5 and further described in connection with FIGS. 1-5 below.

FIG. 1 shows an overhead view of the animal waste collection device of the present invention (10) in the open position. The animal waste collection device (10) comprises a first elongated handle (15) terminating at one end with a shovel means (45) configured for pushing animal waste towards a bag held in the open configuration in the rim means (55). The opposite end of the first elongated handle (15) terminates with a first handle grip (20) that is configured to accept at least a portion of the hand of the user. The device of the present invention (10) also comprises a second elongated handle (25) terminating at one end with a rim means (55) for attaching a bag and holding the bag in an open position directly across from the shovel means (45) of the first elongated handle (15). The opposite end of the second elongated handle (15) terminates with a second handle grip (30) that is configured to accept at least a portion of a hand of a user.

As shown in FIG. 1, the first elongated handle (15) is attached to the second elongated handle (25) at a pivot point (40) that is specifically position so as to allow the handles grips of the first and second elongated handles (25 and 40) to move towards and away from one another thereby moving the shovel means (45) and rim member (55) towards and away from each other. The first and second elongated handles (25 and 40) are movably connected to each other at pivot point (40) so as to provide a scissor-like movement. That is, when the first and second grip handles (20 and 30) are moved away from each other the shovel means (45) and rim means (55) also move away from each other and when the first and second grip handles (20 and 30) are moved towards each other the shovel means (45) and rim means (55) also move towards each other. This action allows the device to collect waste into the disposable bag attached to the rim means (55) by being pushed into the bag by the shovel means (45).

The pivot point further contains a grommet having a first and second part (shown in FIG. 3) that when put together holds the first and second elongated handles (15 and 25) in this movable position. It is understood that connectors other than grommets can be used and these still fall within the scope of the present invention.

As shown in FIG. 1 the device of the present invention (10) may also be equipped with a quick release (65) that is attached to a wire rim (60) configured to mate with at least a portion of the rim means (55) so as to sandwich the disposable bag to the rim means (55). This configuration provides structure to assure that the disposable bag is firmly held in the open position so that it can receive animal waste pushed therein by the shovel means (45) without falling off of the rim. This is achieved without having to adhere a portion of the bag to the rim means (55) by an adhesive and assures that the disposable bag is easily released when the wire rim (60) is removed from the rim means. Other configurations of the rim means (45) can be used to hold the disposable bags in place that do not require a wire rim. These configurations include rim means that have hooks, tabs and/or indentations thereon that can accept specially designed bags thereby holding the bag in place while animal waste is being pushed in to the open bag. These embodiments are also envisioned as being part of the present invention.

In one embodiment of the present invention, the device (10) is equipped with a quick release (65) that is attached to the device (10) of the present invention at a position that is accessible for activation by the user's hand positioned within the handle grips of the device. That is, the quick release can be used to move the wire rim (60) away from the rim means (55) so as to allow the bag containing the waste to fall free from the rim means (45). This allows a user to dispose of animal waste by positioning the device over a garbage pail (or other place of disposal) so that the waste in the bag is at the lowest point possible, activating the quick release (65) allowing gravity to cause the disposable bag to fall off of the rim means (55) into the disposal site. In the alternative the bag can be closed prior to disposal by releasing the bag and using a twist tie closing the bag for disposal. The disposable bags used with the device should be sized so as to be able to fall off of the rim means (55) when the wire rim (60) is released. This allows the user to dispose of the animal waste pick up in the bag without ever touching the bag thereby eliminate the possibility of coming in direct contact with the user's hand.

Figure 2:
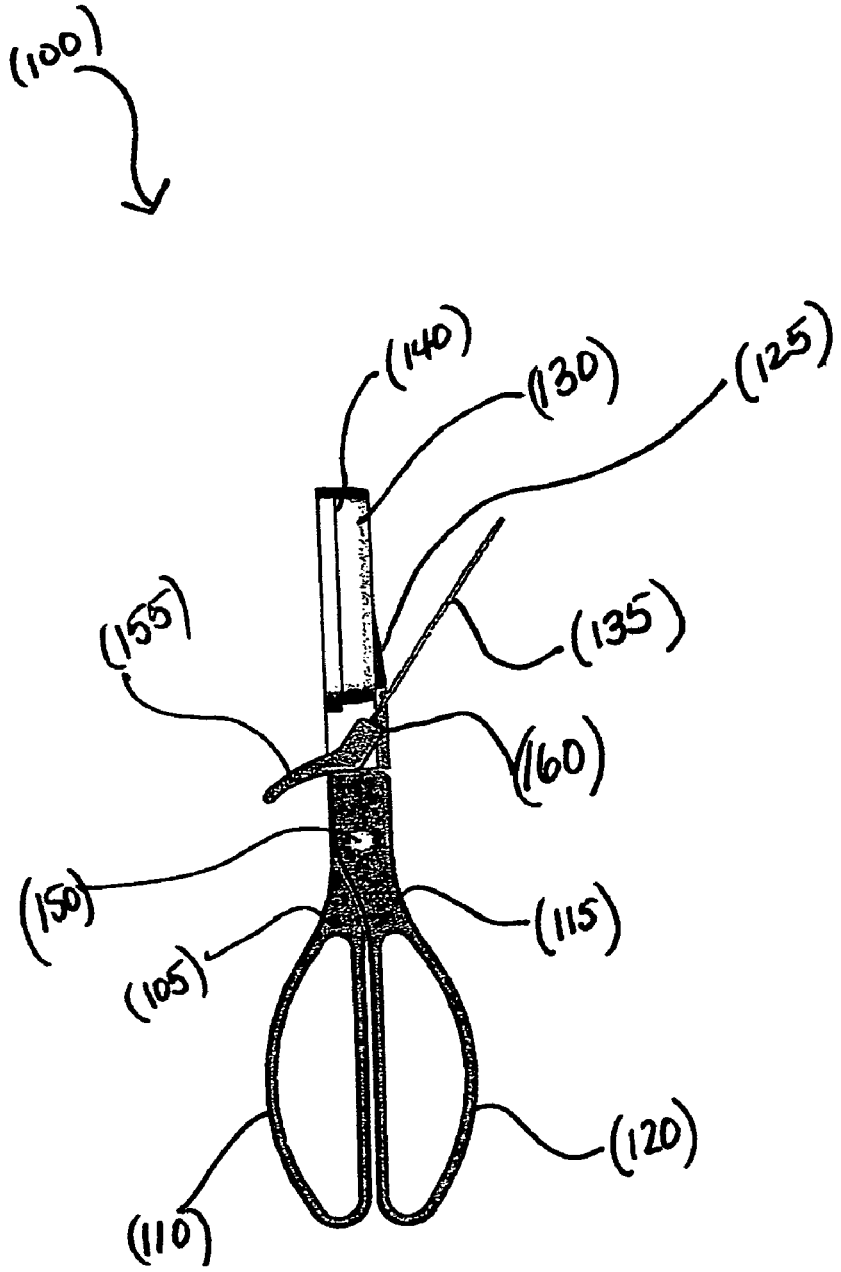
FIG. 2 shows an overhead view of the device in the closed position.

FIG. 2 shows an overhead view of the animal waste collection device of the present invention (100) in the closed position. As described the device shown in FIG. 1 above, the animal waste collection device (100) shown in FIG. 2 comprises a first elongated handle (105) terminating at one end with a shovel means (125) which is configured for pushing animal waste towards a bag held in the open configuration in the rim means (130). The opposite end of the first elongated handle (105) terminates with a first handle grip (110) that is configured to accept at least a portion of the hand of the user. The device of the present invention (100) also comprises a second elongated handle (115) terminating at one end with a rim means (130) and the opposite end a second handle grip (120). The second handle grip is similarly configured as the first handle grip (110). The device is shown with the first and second handles (110 and 120) in close proximity to each other and the shovel means (125) within the frame of the rim means (130). This is considered the closed position.

In one embodiment of the present invention, the rim means (130) of the device (100) may contain a ridge (140) on the outside surface. This ridge (140) may be a dividing line that separates two different thicknesses of the rim means (130) of the device (100). The ridge (140) forms a resting place for the wire rim (135), which sandwiches the bag to the rim means (130), so as to hold the disposable bag in place.

As in FIG. 1, the first elongated handle (105) of FIG. 2 is attached to the second elongated handle (115) at a pivot point (150) that permits movement of the handles in a scissor-like movement. As the grip handles move away from one another, the shovel means (125) and rim means (130) move away from each other. The rim means can be configured to be slightly larger than the shovel means (125) so that it either fits into the shovel means (125) or rests against it. Either design is possible since the function of the shovel means (125) is to push waste into the open bag.

Figure 3:
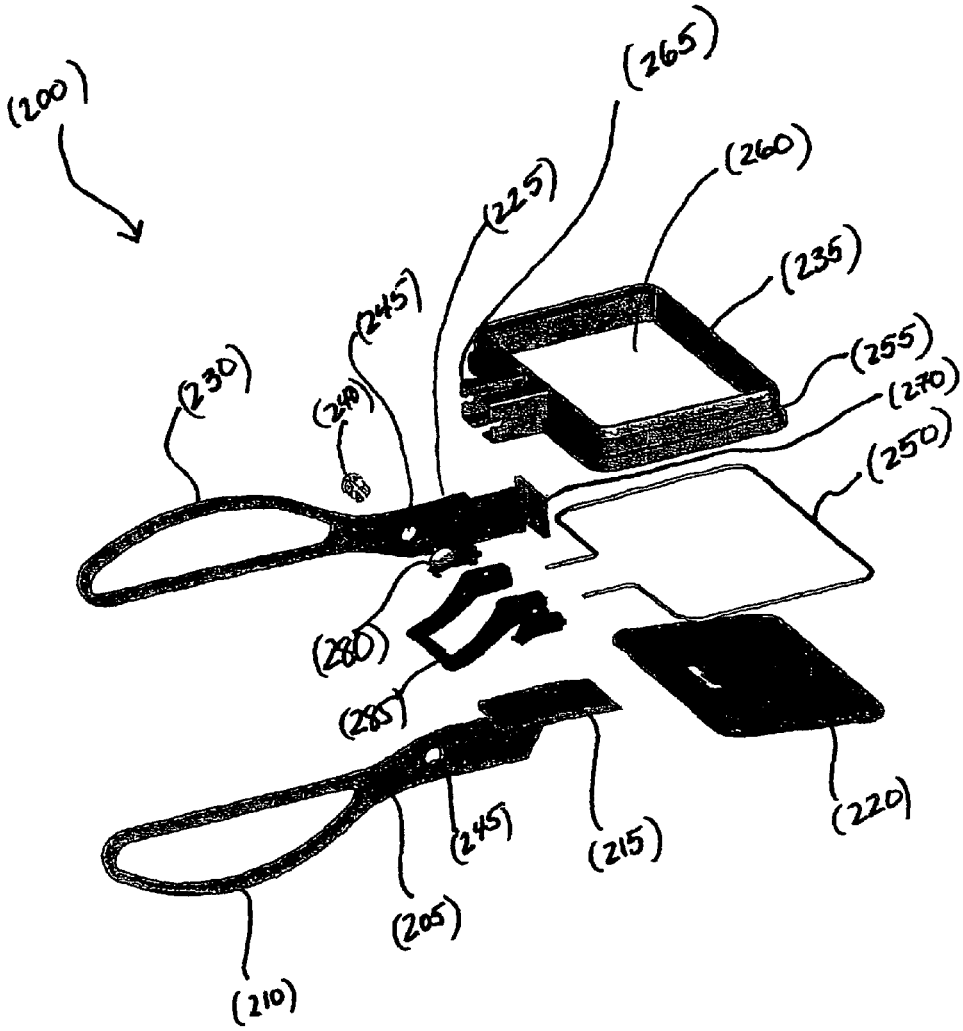
FIG. 3 shows an overhead schematic view of the present invention.

As in the pivot point of FIG. 1, the pivot point of FIG. 2 can also be a grommet/rivet having first and second parts (as shown in FIG. 3) that when put together holds the first and second elongated handles (105 and 115) in the above described movable position. It is understood that connectors other than grommets can be used and these still fall within the scope of the present invention.

As shown in FIG. 1, the device shown in FIG. 2 can also be equipped with a quick release (155) that is attached to a wire rim (135) and is configured to mate with at least a portion of the rim means (130). The wire rim (135) locks the disposable bag to the rim means (130) when closed and release it when opened. The quick release (155) can be spring loaded so that a simple touch would move the wire rim (135) away from the rim means (130) to release the bag. A new bag can then be placed in the rim means (130) and the quick release (155) reset so as to lock the new bag to the rim means (130) so that the device can be used again. Other configurations of the rim means (130) can be used to hold the disposable bags place instead of the wire rim/rim means (135/130) combination. These configurations include rim means that have hooks, tabs and/or indentations thereon that can accept specially designed bags thereby holding the bag in place while animal waste is being pushed in to the open bag. These embodiments are also envisioned as being part of the present invention.

It is noted that the designs of the present invention shown in FIGS. 1 and 2 are simply for illustration purposes only and other handle designs, other elongated handle designs as well as rim means and shovel designs can be used as long as they able to achieve the same actions as the structures described. The overall goal of the device of the present invention is to provide a device that allows the user to pick up and dispose of animal waste without coming in direct contact with the user's hand.

The device of the present invention and how the parts fit together and interact is further described in connection with FIG. 3. FIG. 3 shows an overhead schematic view of the device of the present invention (200). A first elongated handle (205) has a first handle grip (210) at one end and an attachment surface (215) to attach the shovel means (220) thereto at the opposite end. The shovel means (220) can be glued, welded, screwed or molded as one piece to the attachment surface for the shovel means (215) to produce a first elongated handle having a first grip handle (210) at one end and a shovel means (220) at the other.

Similarly, the second elongated handle (225) has a second handle grip (230) at one end and an attachment surface for the rim means (270), which attaches to a portion of the rim means (255). Once assembled, the first elongated handle is complete with a first handle grip (210) at one end and a shovel means (220) at the other. The quick release (285) also attaches to the second elongated handle (225) in the vicinity of the rim means (255). The wire rim (250) is shown in a rectangular/square shape with two extending portions that attach to the quick release (285) so that when the quick release (285) is activated the wire rim (250) will move away from rim means (255). The quick release can either be produced with a memory that when pressed causes the wire rim (250) to move away from the rim means (255) and returns back to its original position once released. In the alternative the quick release can be spring-loaded.

Both the first and second elongated handles (225, 205) are produced with a pivot point (245) in the form of a hole. Once the two holes are aligned a first part of a grommet is placed on the outside portion of the hole of the first elongated handle (205) and the second part of the grommet is set on the outside portion of the hole of the second elongated handle (225). The first and second parts of the grommet are squeezed locked together so as to maintain the first and second elongated handles in a moveable position. Other types of fastener can be used as long as they allow the two elongated handles to move in a scissor-like movement. In fact the pivot point can be molded directly in each elongated handle and snapped together when placed in the right position.

The rim means (255) is shown in a square/rectangular shape with an open portion, but other shapes can be used as long as the shape allows at least a portion of the rim means (255) to contour with the ground so as to allow the shovel means to push the waste into the open portion of the rim means into the attached bag.

Figure 4:
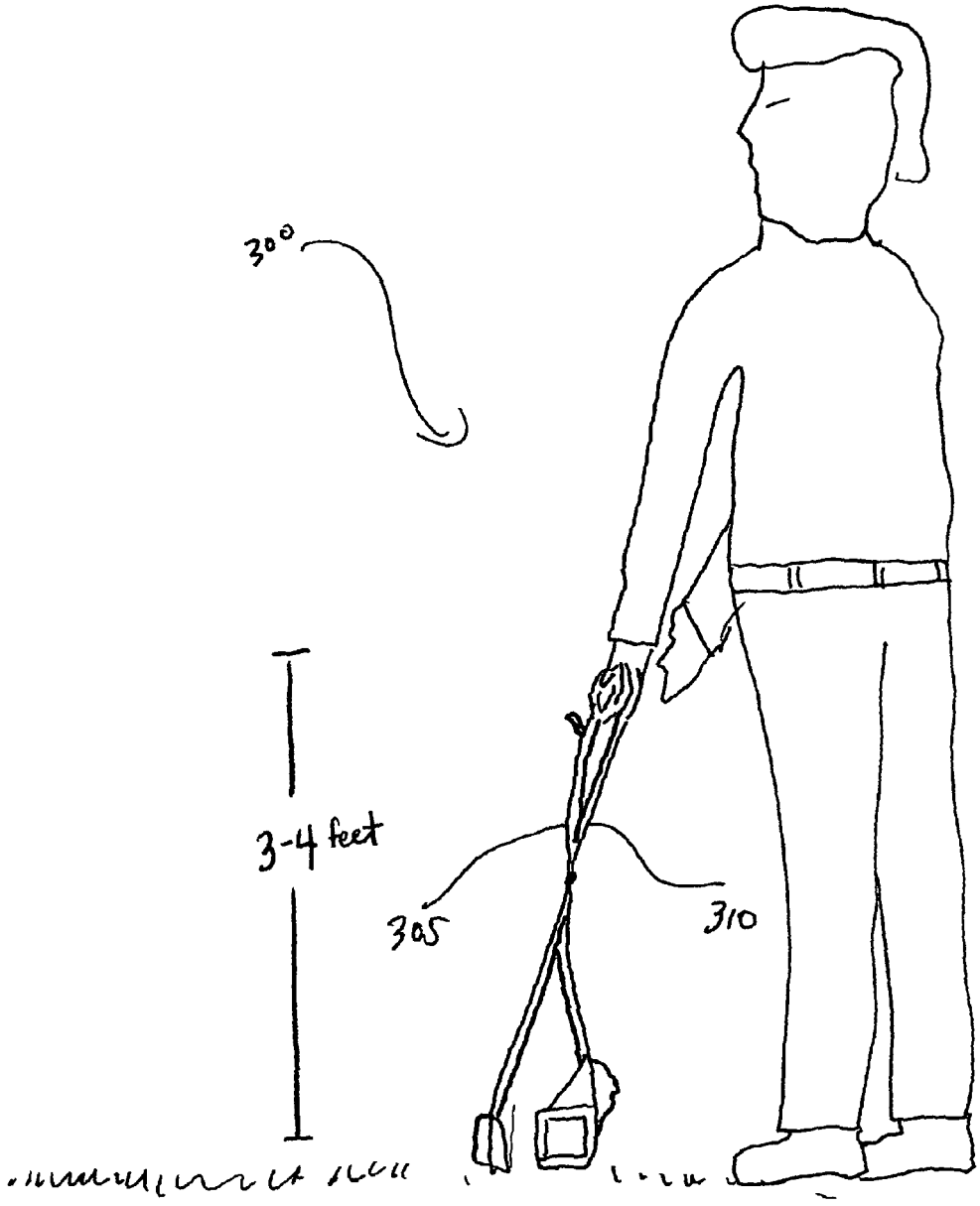
FIG. 4 shows a person using the device of the present invention.

FIG. 4 shows an animal waste collection device of the present invention having all of the parts described in FIGS. 1-3 except the first and second handles (305 and 310) are long enough to pick-up waste off of the ground without bending. All of the other parts are configured as shown in FIGS. 1-3 and operate in the same manner. The length of the elongated handles can be between about 1-4 feet, preferably about 3 feet. The configurations shown in FIG. 1-3 are about 1-3 feet, preferable about 1.5 feet and more preferably about 1 foot. The 3-foot model shown in FIG. 4 can be a home model that can be stored in the garage and used when dog is allowed to go to the bathroom in the backyard. Although the large size of the device (300) shown in FIG. 4 makes it easier to pick up waste without bending over, it is larger and heavier than the models shown in FIG. 1-3 and therefore more difficult to carry while taking the dog for a walk. Conversely, the compact design of the device shown in FIGS. 1-3 can be carried when taking the dog for a walk.

Figure 5:
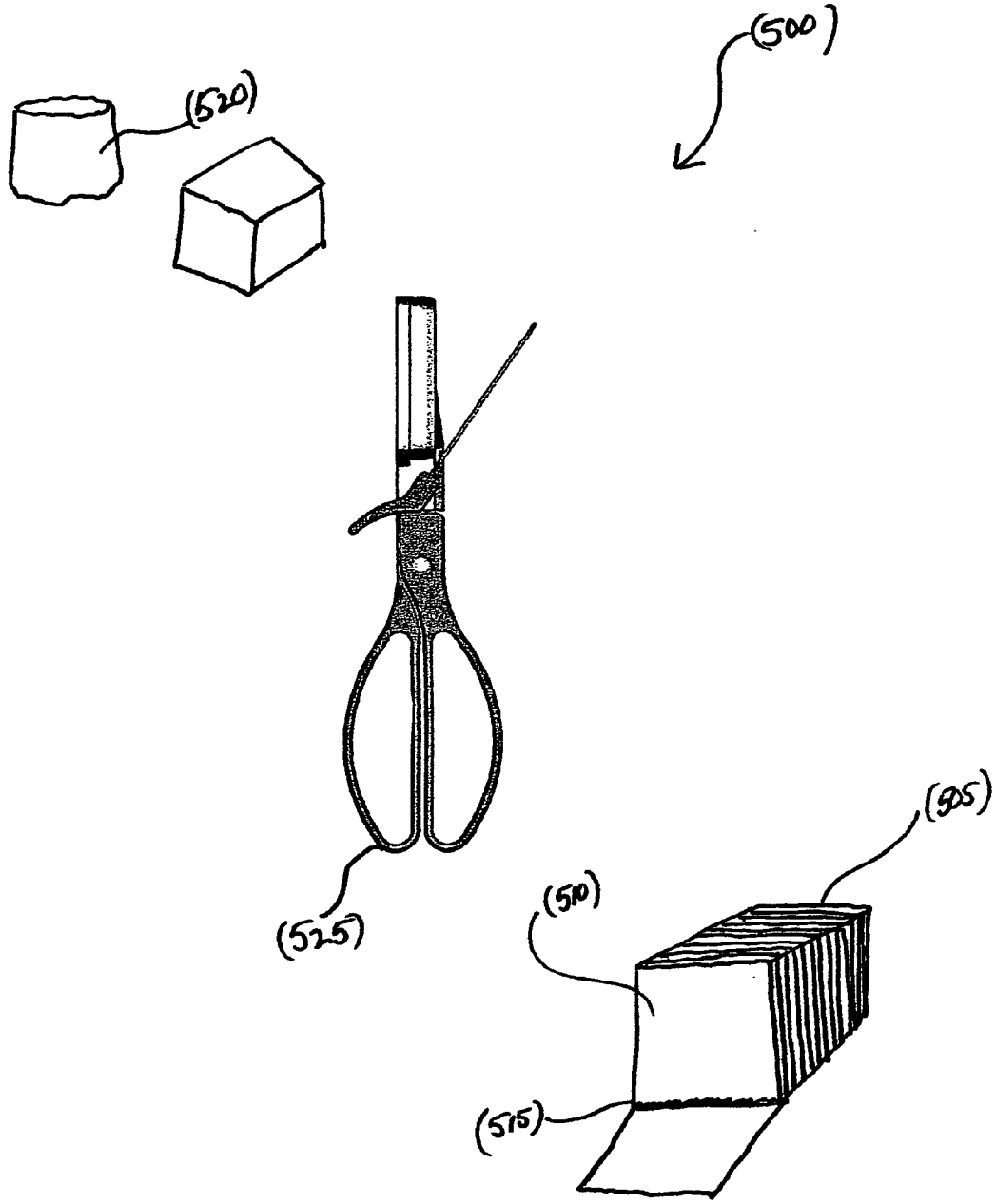
FIG. 5 shows a perspective view of a waste disposal kit of the present invention.

FIG. 5 shows a starter kit of the present invention (500) comprising the animal waste collection device of the present invention (525), a stack of a plurality of cleaning pads (505) wherein a single pad (510) can be removed from the stack (505) along an attachment point (515). Once removed the pad (505) can be attached to the shovel means of any of the devices shown in FIG. 1-4. The pad (505) is designed to fit the shovel mean and may be attached to the shovel means by a sticky portion or the shovel means can have an insert flange that the pad can slip under. Either way the pad (505) is designed to be disposed of with the waste and bag and protect the shovel means from getting soiled in the process. Also included in the starter kit is a plurality of bags (520) that are sized to fit into the rim means and held in place by the wire means shown in FIG. 1-4. The plurality of bags can be similar to a small zip-lock bags or pooper scooper bags available on the market today. Once the wire rim of FIGS. 1-4 is released away from the rim means the bag (520) will fall out and can be directly discarded or tied and then discarded without ever soiling the user with the waste.

While these figures and the description of the present invention provided above describe preferred embodiments of the present invention, various modifications of, for example, components, materials and parameters, will become apparent to those skilled in the art, and all such modifications and changes are intended to fall within the scope of the claims of the present invention.

What is claimed is:

1. An animal waste collection device comprising:

a first elongated handle and a second elongated handle said first and second elongated handles being connected to each other at a pivot point, said pivot point positioned so as to movably connect said first and second handles so as to provide a scissor-like movement;

said first elongated handle terminating at one end with a shovel means for pushing waste in a defined direction and a handle grip at the opposite end;

said second elongated handle terminating at one end with a rim means and a handle grip at the opposite end, said rim means configured to receive and removably attach a bag having an open end and holding said bag in an open position so that animal waste pushed therein by said shovel means is received and stored, an attaching member in the form of a wire configured to fit against said rim means in order to hold said bag in an open position so that said bag will not release when waste is pushed into said opened bag by said shovel means;

a disposable pad or sleeve removably attachable to said shovel means, said disposable pad or sleeve configured to protect said shovel means from getting soiled with said waste when pushing said waste into said open bag of said waste collection device; and wherein movement of said handle grip of said first and second elongated handles towards one another causes said shovel means to move in the direction of said open bag attached to said rim means so as to collect said waste in said bag.

2. The animal waste collection device of claim 1 further comprising a quick release lever attached to said attaching member for holding said bag on said rim means, said quick release lever configured to release said bag from said rim means upon activation.

3. The animal waste collection device of claim 1 wherein the first and second elongated handles are about 1 to about 4 feet in length.

4. The animal waste collection device of claim 3 wherein the first and second elongated handles are about 3 feet in length.

5. The animal waste collection device of claim 3 wherein the first and second elongated handles are about 1 foot in length.

6. The animal waste collection device of claim 1 wherein said shovel means for pushing waste in a defined direction has at least one substantially flat surfaced position facing towards said open bag.

7. The animal waste collection device of claim 1 wherein said device is made from metal, alloys, reinforced plastic, composite material, poly vinyl chloride (PVC), fiberglass, hardened rubber, manmade materials or mixtures thereof.

8. The animal waste collection device of claim 1 wherein said handle grip of said first elongated handle and said handle grip of said second elongated handle is configured as a closed loop having an interior portion of said loop that is large enough to fit at least a part of a users hand.

9. The animal waste collection device of claim 8 wherein the interior portion of said loop has a handgrip formed therein for better gripping.

10. An animal waste collection kit for collecting and disposing of animal waste comprising;

the animal waste collection device of claim 1, a plurality of waste disposal bags specifically configure to fit said rim means for attaching a bag and holding said bag in an open position of the device of claim 1; and a plurality of disposable pads or sleeves configured to fit said shovel means for pushing waste in a defined direction of the device of claim 1 so as to prevent direct soiling of said shovel means.

11. The animal waste collection kit of claim 10 wherein said first and said second elongated handles of said animal waste collection device are both about 1 to about 4 feet in length.

12. The animal waste collection kit of claim 11 wherein said first and said second elongated handles of said animal waste collection device are either both about 1 foot in length or about 3 feet in length.

13. A method for picking up and disposing of animal waste comprising:

a) positioning said animal waste collection device of claim 1 in close proximity to animal waste to be picked up;

b) activating said first and second elongated handles of said device of claim 1 so that said shovel means is away from said open bag;

c) repositioning said first and second elongated handles of said device of claim 1 so as to push said animal waste into the open bag for disposal; and d) repeating step a through step c until completed.

14. The method for picking up and disposing of animal waste of claim 13 wherein said first and said second elongated handles of said animal waste collection device are both about 1 to about 4 feet in length.

15. The method for picking up and disposing of animal waste of claim 14 wherein said first and said second elongated handles of said animal waste collection device are either both about 1 foot in length or about 3 feet in length.

* * * * *